US006375375B1

(12) United States Patent
Gebb et al.

(10) Patent No.: US 6,375,375 B1
(45) Date of Patent: Apr. 23, 2002

(54) CONTAINER FOR STORING AND DISPENSING COSMETIC STICK PRODUCTS

(75) Inventors: Stephen Elton Gebb; Laurent Jean Marie Hainaut; Anne Brunn, all of New York, NY (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 09/727,867

(22) Filed: Dec. 4, 2000

(51) Int. Cl.[7] ..... B43K 5/12
(52) U.S. Cl. ..... 401/194; 401/192; 401/52
(58) Field of Search ..... 401/194, 195, 401/192, 49, 68, 78, 52

(56) References Cited

U.S. PATENT DOCUMENTS

| | | | | | |
|---|---|---|---|---|---|
| D92,230 | S | | 5/1934 | Cox | |
| D161,051 | S | | 11/1950 | Piccoli | D86/10 |
| 2,595,403 | A | * | 5/1952 | Neuschafer | 401/194 |
| D201,420 | S | | 6/1965 | Bernard | D86/10 |
| 3,217,869 | A | | 11/1965 | Katz | 206/56 |
| 3,706,354 | A | | 12/1972 | Gruska | 401/78 |
| 3,806,263 | A | | 4/1974 | Webster | 401/78 |
| 4,422,545 | A | * | 12/1983 | Kadoory | 220/212 |
| D280,451 | S | | 9/1985 | Bakic | D28/88 |
| D331,815 | S | | 12/1992 | DiSomma | D28/4 |
| 5,221,153 | A | | 6/1993 | Spatz | 401/98 |
| D343,474 | S | | 1/1994 | Chen | D28/87 |
| 5,842,802 | A | | 12/1998 | Lang | 401/68 |
| 5,957,607 | A | * | 9/1999 | Tsai | 401/194 |
| D417,752 | S | | 12/1999 | Bakic | D28/85 |

OTHER PUBLICATIONS

Bottlemate, Inc., Product Catalog, p. 32, Jan. 1, 1999.

* cited by examiner

*Primary Examiner*—David J. Walczak
(74) *Attorney, Agent, or Firm*—Julie Blackburn

(57) ABSTRACT

A container for storing and dispensing colored cosmetic stick products comprising an external base having a portion for housing the cosmetic stick, a rotational assembly enabling extension and retraction of said stick, and a bottom portion which is hollowed out to form a cavity; a cap which telescopically fits onto the base for covering the stick; an insert containing a color indicator, said insert fitted into the cavity in the bottom of the base and forming the bottom of the base, said insert indicating the color of the cosmetic stick product found within the container.

22 Claims, 5 Drawing Sheets

CONTAINER FOR STORING AND DISPENSING COSMETIC STICK PRODUCTS

TECHNICAL FIELD

The invention is in the field of containers for storing and dispensing cosmetic products in stick form, particularly colored cosmetic sticks such as lipstick, eyeshadow, blush, foundation, and the like.

BACKGROUND OF THE INVENTION

One long standing problem with cosmetic containers used to store and dispense colored cosmetic sticks is that they do not enable the consumer to see the color of the cosmetic material within. Most often the consumer is forced to rely on printed color indicators attached to in store cosmetic displays to reflect the color of the product they wish to purchase. Consumers are generally dissatisfied with this approach and wish to see the color of the actual product prior to purchase. When cosmetic containers do not readily lend themselves to such inspection, consumers tend to tamper with the containers by removing lids, opening blister packs, and so on. Consumers will then not purchase cosmetics that have been tampered with, and the products are returned to cosmetic companies as damaged goods. This results in considerable expense for cosmetics companies.

A number of solutions to this problem have been proposed throughout the years. For example, U.S. Pat. No. 5,257,704 teaches a tamperproof lipstick case where the rotational assembly is shrink wrapped so that the consumer can remove the cap of the lipstick to view the color but cannot turn the rotational assembly to eject the stick without removing the shrink wrap. While this type of design reduces breakage, the consumer is able to view only the top of the lipstick within the case and may not get a true sense of the actual color. In addition, nothing prevents consumers from removing the shrink wrap.

Another tamperproof lipstick component is disclosed in U.S. Pat. No. 5,451,113, which teaches a clear protective under cap designed to fit on top of the lipstick bullet when it is partly e)tended. The cap of the lipstick fits over the protective under cap. The under cap is secured to the lipstick such that the rotational assembly that causes ejection of the stick is secured and cannot be turned by the consumer. Yet, the consumer is able to view the stick through the clear under cap. One problem with this design is that it works only with lipstick dispensers that have a certain type of design only, in particular a square cross-sectional shape. Second, it involves manufacture of an additional item which adds expense and takes time to assemble.

The ideal cosmetic stick container would enable consumers to accurately view the color of the cosmetic without the risk of undue breakage, and would not require any additional componentry that would add to expense and assembly time.

SUMMARY OF THE INVENTION

The invention comprises a container for storing and dispensing colored cosmetic stick products comprising:

(a) an external base having a portion for housing the cosmetic stick, a rotational assembly enabling extension and retraction of said stick, and a bottom portion which is hollowed out to form a cavity, (b) a cap which telescopically fits onto the base for covering the stick, (c) an insert containing a color indicator, said insert fitted into the cavity in the bottom of the base and forming the bottom of the base, said insert indicating the color of the cosmetic stick product found within the container.

The container for storing and dispensing cosmetic stick products according to the invention enables the consumer to accurately assess the color of the cosmetic product found within without opening the container or associated packaging. The dispenser can be sold in a blister pack or it can be shrink wrapped in the closed position. This, in turn, substantially reduces unit damage and/or breakage, which is a costly problem for cosmetics companies.

DETAILED DESCRIPTION OF THE PREFERRED EMBODIMENT

Figure 3:
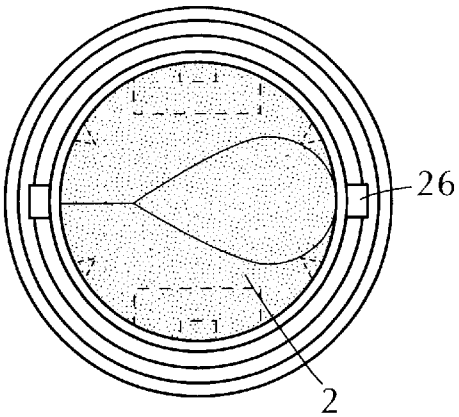
FIG. 3: is a top plan view of the container of FIG. 2 with the cap removed and the cosmetic stick in view.
Figure 3A:
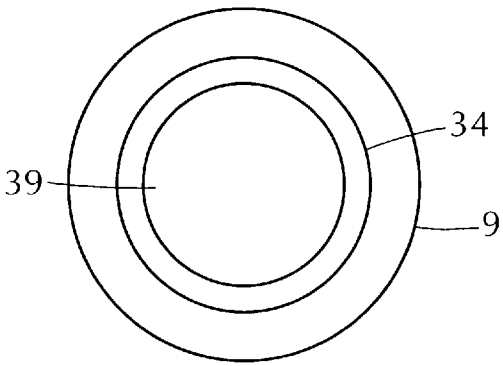
FIG. 3A: is a top plan view of the insert with color indicator.
Figure 2:
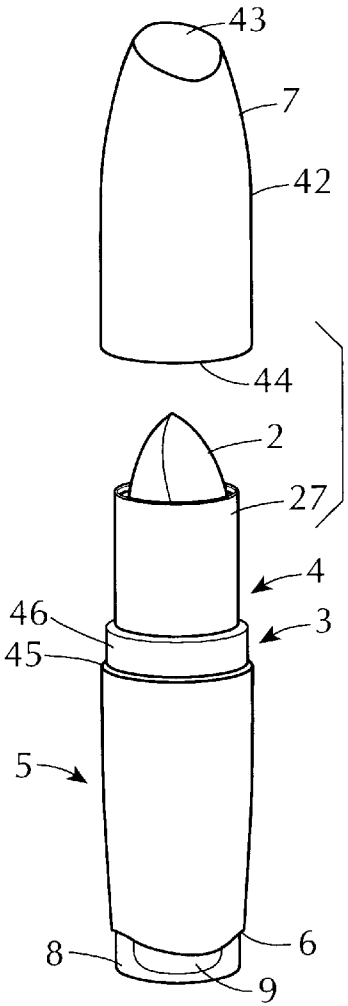
FIG. 2: is the container of FIG. 1 in the open position with the cap removed and the cosmetic stick in view.
Figure 1:
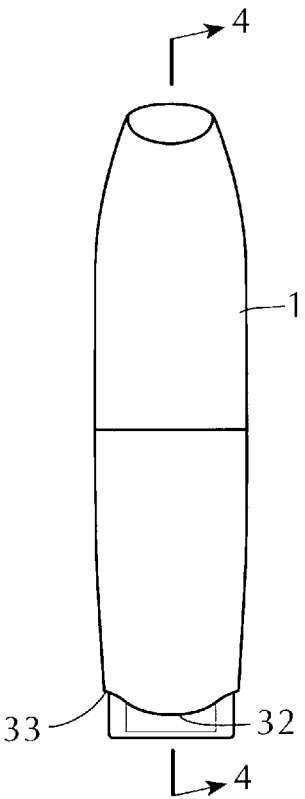
FIG. 1: is a front perspective view of a preferred embodiment of container in accordance with the invention, which container is in the closed position.

FIG. 1 depicts a perspective view of the container 1 according to the preferred embodiment of the invention. The container 1 may be used to contain and dispense all manner of stick shaped cosmetic products including lipstick, eyeshadow, foundation makeup, sunscreen, fragrance, and the like. The only requirement for the cosmetic is that it must be sufficiently self-supporting to enable it to be housed in the container 1 and dispensed therefrom. Preferably the container is used to store and dispense lipstick 2 as depicted in FIG. 2. The container 1 comprises a external base 3 with a housing 4 for the cosmetic stick 2. The external base 3 comprises a rotational assembly 5 enabling extension and retraction of the stick 2, and a bottom portion on the external base 3 which contains a cavity 6. A cap 7 telescopically fits onto the external base 3 and covers the stick 2 when the container 1 is in the closed position. An insert 8 containing a color indicator 9 is fitted into the cavity 6. The color indicator 9 exactly matches the color of the cosmetic stick 2 found within the container 1.

Figure 6:
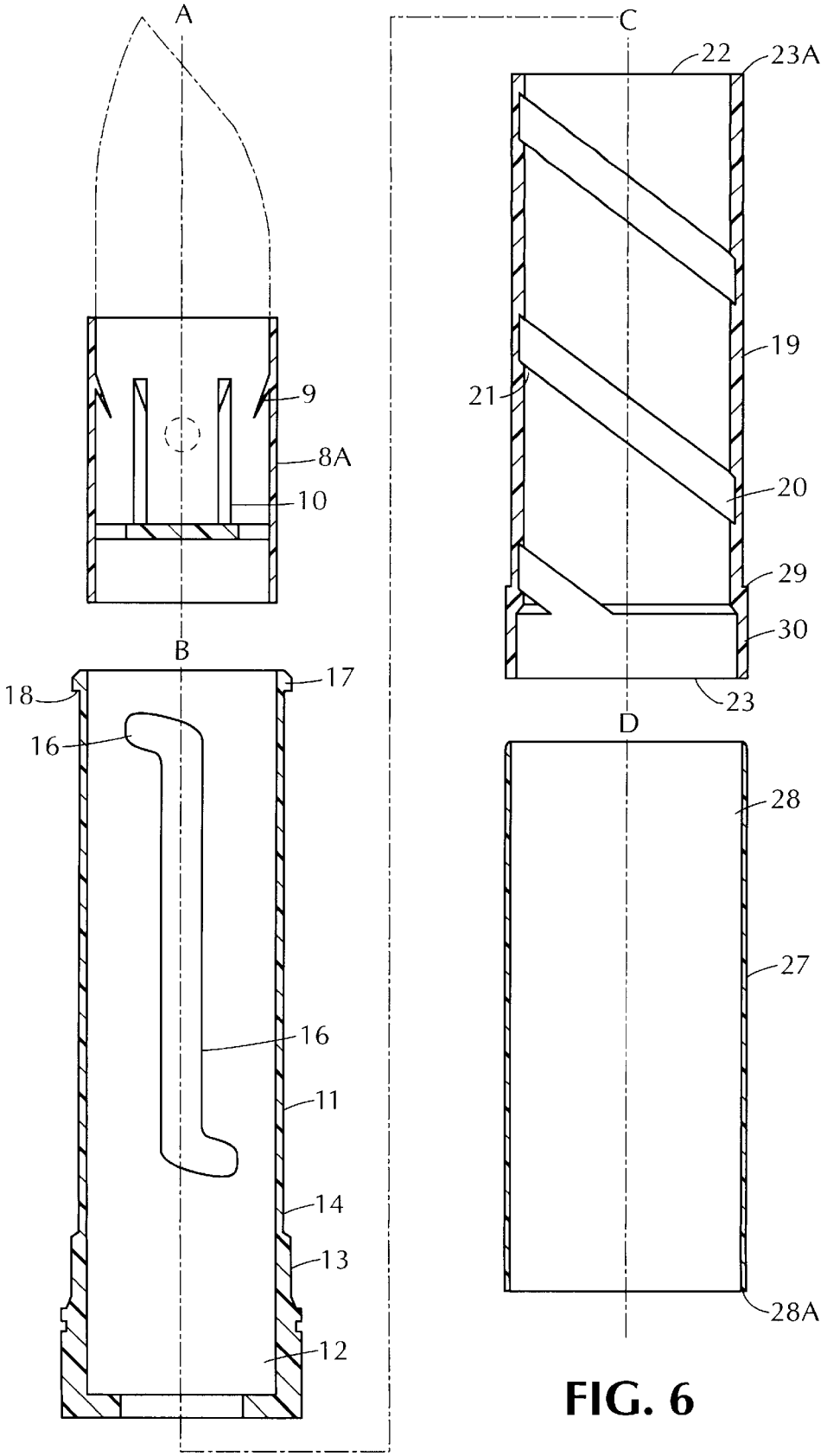
FIG. 6A–D: is an exploded view of the container showing the various pieces that comprise the base.
Figure 7:
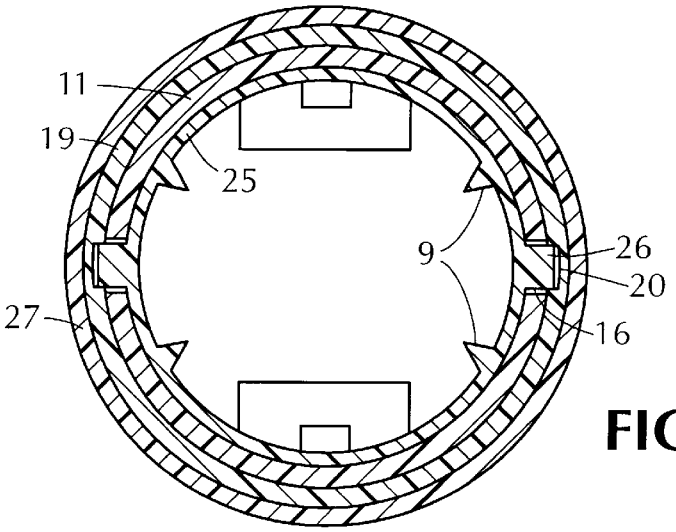
FIG. 7: is a cross sectional view of the components of FIGS. 8,9,10, and 11 in nested relation.
Figure 8:
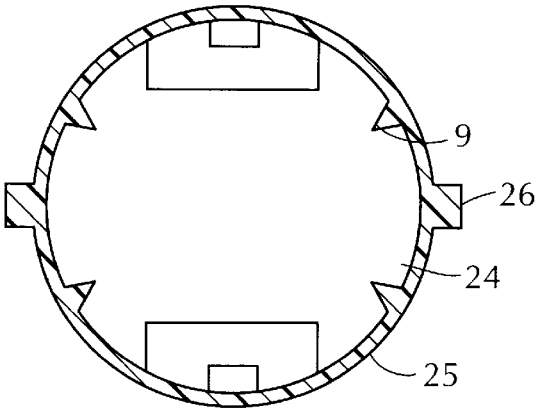
FIG. 8: is a cross sectional view of the component of FIG. 6A, which is the cup into which the base of the cosmetic stick is fitted.
Figure 9:
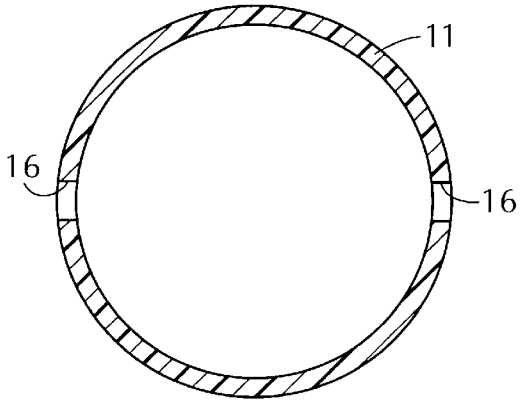
FIG. 9: is a cross sectional view of FIG. 6B.
Figure 10:
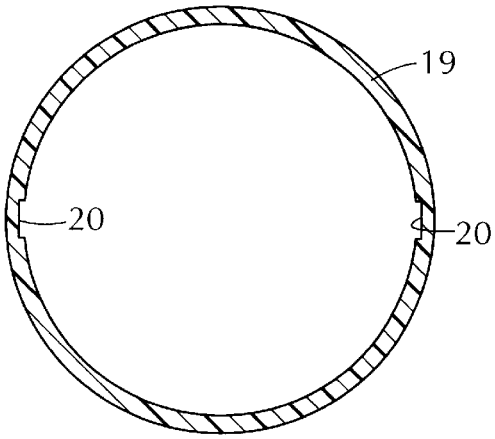
FIG. 10: is a cross sectional view of FIG. 6C.
Figure 11:
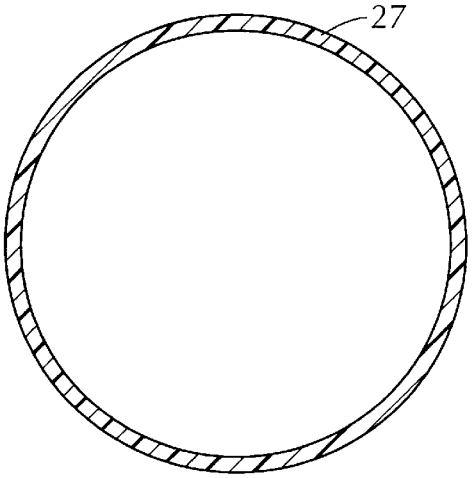
FIG. 11: is a cross sectional view of FIG. 6D.

More specifically, the external base 3 comprises a housing 4 for the cosmetic stick which comprises a cup 8A as depicted in FIG. 6A which depicts the cup 8A with the broken lines illustrating how a cosmetic stick 2 is placed therein. The cosmetic stick 2 is generally prepared in the usual manner by pouring into cosmetic stick molds and cooling. The resulting cosmetic stick "bullets" are removed from the molds when hardened and fitted into the cup 8A. Preferably, the cup 8A has barbs 9 which assist in anchoring the stick 2 in the cup 8A, as well as longitudinally extending ribs 10. In the most preferred embodiment of the invention, the cup 8A is as depicted in U.S. Pat. No. 6,116,801, which is hereby incorporated by reference in its entirety. While the cup 8A is preferably circular in cross section, it is possible that the cup may be oval, square, or other shapes. The cup 8A has an inner surface 24 and an outer surface 25 (see FIG. 8). On the outer surface 25 of the cup 8A are a pair of cam followers 26 which are generally cylindrical members spaced apart 180°.

The external base 3 contains a dispenser base 11, which is formed from a hollow tubular member which has segments of varying diameter 12,13, and 14 but with longitudinal axes in alignment. Segment 14 is formed with a pair of elongated openings 15 terminating at either end by a lateral opening 16. The openings 15 are generally spaced 180° apart with only one such opening being shown. There is a surrounding rib 17 which contains an underlying lip 18 which circumscribes the dispenser base 11.

Figure 4:
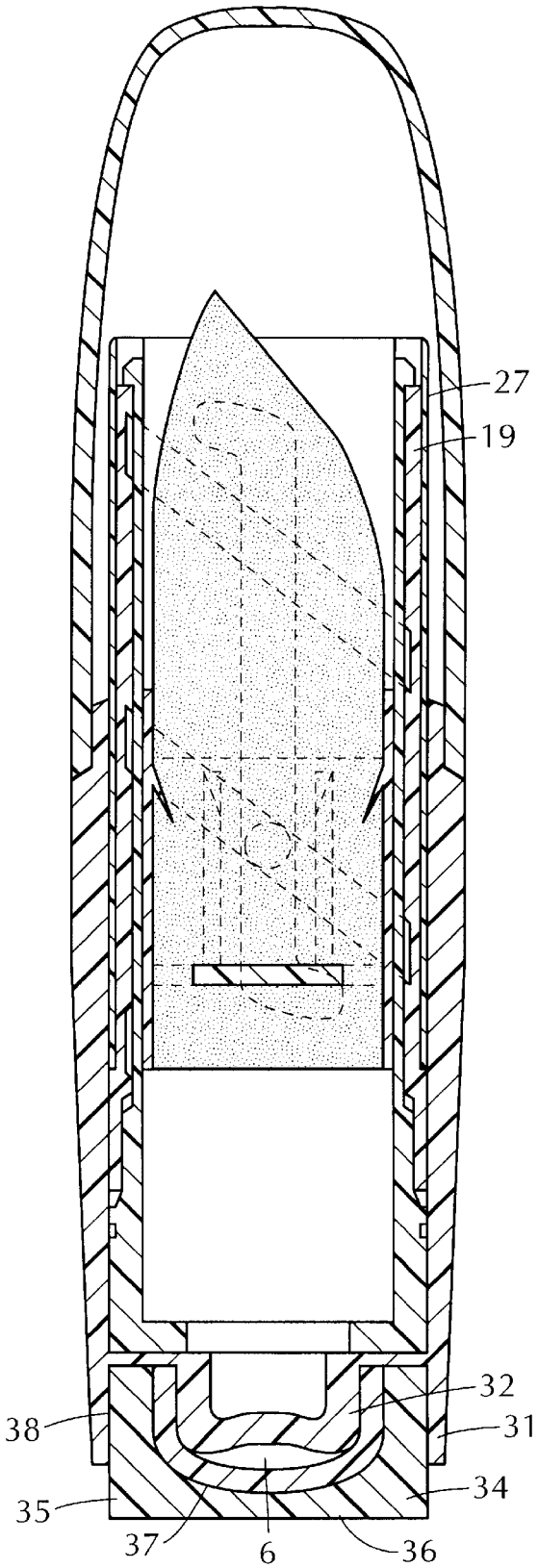
FIG. 4: is a cross sectional view of the container taken across 4—4 of FIG. 1.
Figure 5:
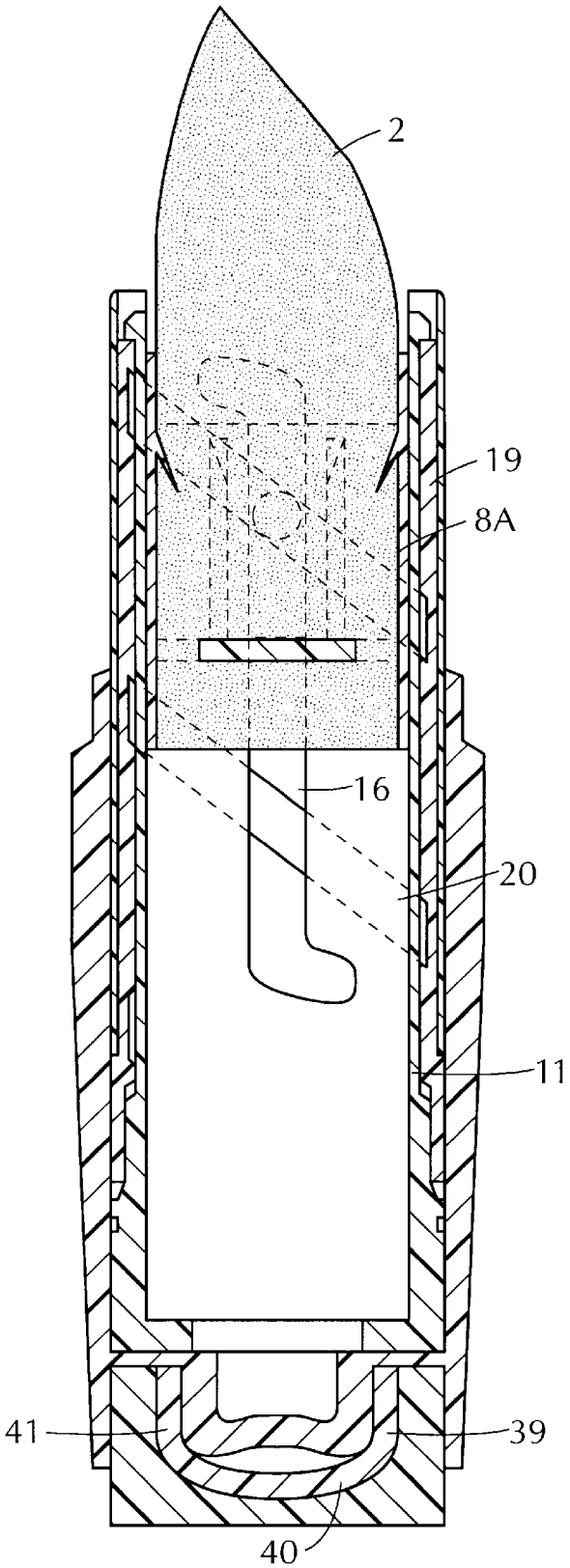
FIG. 5: is a cross sectional view of the container of FIG. 4 where the cosmetic stick is in the extended position.

Referring to FIG. 6C the outer shell 19 is constructed as a hollow tubular member having an inside diameter slightly larger than the external diameter of dispenser base 11. The outer shell 19 contains an external spiral shaped groove 20 formed in the interior surface 21 thereof The spiral groove communicates between open ends 22 and 23 of the outer shell 19. Outer shell 19 is positioned over dispenser base 11 as best depicted in FIGS. 4 and 5. Due to the slight dimensional differences between outer shell 19 and dispenser base 11, the outer shell 19 is rotatable about its longitudinal axis. In this arrangement, the groove 20 is arranged such that it overlies openings 15 and 16 at various positions therealong as the outer shell 19 is rotated. The outer shell 19 is retained in its position by the rib 17 and with underlying lip 18 which fits over open end 22 of outer shell 19 the underlying lip 18 fitting over the edges 23A of outer shell 19.

The cup 8A containing the cosmetic stick 2 is inserted into the dispenser base 11 such that the cam. followers 26 register with openings 15 and 16 in the dispenser base 11 and at the same time are received within the groove 20 in outer shell 19. As such, the outside diameter of the cup 8A is slightly less than the inside diameter of the dispenser base 11 thereby enabling the cup 8A to slide longitudinally therethrough during operation of the dispenser base 11. Together the dispenser base 11, outer shell 19, cup 8A, external base 3, and outer sleeve comprise the rotational assembly.

FIG. 6D illustrates an external sleeve 27 which has an inner diameter 28 slightly larger than the external diameter of outer shell 19. The external sleeve 27 is positioned in nested relationship with cup 8A, dispenser base 11, and outer shell 19. In particular, external sleeve 27 has a bottom edge 28A which fits snugly against a circumferential shelf 29 found on the lower portion 30 of the outer shell 19. The consumer grips external sleeve 27 with the fingers of one hand and the external base 3 with the fingers of the other hand. When external base 3 is rotated in one direction the cosmetic stick 2 is extended from the container. When the consumer is done applying the stick to the desired surface, the stick is retracted by rotating the external base 3 in the opposite direction.

The external base 3 comprises a bottom portion comprising a hollowed out cavity 6 (best illustrated in FIGS. 4 and 5). The hollowed out cavity 6 has side walls 31 and a central projection 32. Preferably the sidewalls 31 of the cavity have varying lengths in a sinusoidal shape of varying short and long length portions such that at any one point on a sidewall, the sidewall 180° opposite will be of the same length all though the sinusoidal sidewall lengths do not necessarily have to have this variation in length. For example, FIG. 1 illustrates a long sidewall 32 and a short sidewall 33. The sidewall that is 180° opposite long sidewall 32 is also a long sidewall. Similarly, the sidewall that is 180° opposite short sidewall 33 is also a short sidewall. The short sidewalls enable the consumer to see the insert with color chip and assess the color of the cosmetic found within the container 1.

The color indicator 9 comprises an insert 34 which has sidewalls 35, a base 36, and a cavity 37. The insert is made from a clear thermoplastic material that has the same or very similar index of refraction as glass such that color is visible through it. The sidewalls 35 have an outer surface 38 and the diameter of the outer surface 38 sidewalls is slightly less than the diameter of hollow cavity 6 such that the insert 34 fits snugly into the hollow cavity 6. A color chip 39 fits snugly into the insert 34. The color chip 39 approximates the color of the cosmetic stick 2 product found within the container, and is viewed through the insert 34. The color indicator 9, comprised of the insert 34 and color chip 39 forms a single piece that can be snapped into the hollow cavity 6. The color chip has a base 40 and sidewalls 41 which are designed to snap onto the central projection 32. The single piece formed by the insert and color chip can be pre assembled and snapped onto the central projection of the base 32 during the manufacturing operation. Preferably the color chip is made out of a thermoplastic polymeric material that is combined with the same colorants used in the cosmetic stick composition dispensed in the container. The thermoplastic material may be combined in the molten state with the actual cosmetic material or the pigments used to color the cosmetic material may be used to color the thermoplastic material. Generally, about 1 part of the molten thermoplastic material is mixed with 1 part of colorant and poured into the appropriate molds to cool. After the color chip has hardened, it is removed from the mold and snapped into the insert.

The container 1 of the invention also comprises a cap 42 which telescopically fits onto the external base 3 and covers the cosmetic stick 2. Preferably, the cap 42 is shaped like a lipstick bullet and has a top angled portion 43 that approximates the top of a standard lipstick bullet. The cap 42 has a lower edge 44 that abuts a circumferential ridge 45 that is found on the external base 3. Preferably, the cap friction fits with the peripheral skirt 46 that depends from the circumferential ridge 45.

The container according to the invention provides an aesthetic cosmetic dispenser and carrying case and also enables the consumer to accurate assess the shade of the cosmetic without opening the lipstick.

We claim:

1. A container for storing and dispensing colored cosmetic stick products comprising:

(a) an external base comprising (i) a portion for housing the cosmetic stick, (ii) a rotational assembly enabling extension and retraction of said stick, and (iii) a bottom portion which is hollowed out to form a cavity having sidewalls of varying length, (b) a cap which telescopically fits onto the base for covering the stick, (c) an insert containing a color indicator, said insert fitted into the cavity in the bottom portion of the base and forming the bottom of the base, said insert indicating the color of the cosmetic stick product found within the container.

2. The container of claim 1 wherein the color cosmetic stick is lipstick.

3. The contain(r of claim 1 wherein the rotational assembly comprises a cup.

4. The container of claim 3 wherein the cup contains barbs.

5. The container of claim 3 wherein the cup contains longitudinally extending ribs.

6. The container of claim 3 wherein the cup is circular in cross section.

7. The container of claim 1 wherein the rotational assembly comprises a dispenser base.

8. The container of claim 7 wherein the dispenser base comprises a hollow tubular member.

9. The container of claim 8 wherein the hollow tubular member contains elongated openings spaced 180° apart.

10. The container of claim 9 which contains a surrounding rib that circumscribes the dispenser base.

11. The container of claim 10 wherein the surrounding rib contains an underlying lip which also circumscribes the dispenser base.

12. The container of claim 1 wherein the rotational assembly comprises an outer shell.

13. The container of claim 12 wherein the outer shell contains an external spiral shaped groove formed on the interior surface thereof.

14. The container of claim 13 wherein the external base contains an external sleeve.

15. The container of claim 14 wherein the external sleeve is positioned in nested relationship with a cup, a dispenser base, and the outer shell.

16. The container of claim 1 wherein the sidewalls of varying length are in a sinusoidal shape.

17. The container of claim 1 wherein the sidewalls are the same length 180° apart.

18. A container for storing and dispensing colored cosmetic stick products comprising:

(a) an external base comprising (i) a portion for housing the cosmetic stick, (ii) a rotational assembly enabling extension and retraction of said stick, and (iii) a bottom portion which is hollowed out to form a cavity, (b) a cap which telescopically fits onto the base for covering the stick, (c) an insert comprising a clear thermoplastic material containing a color indicator, said insert fitted into the cavity in the bottom portion of the base and forming the bottom of the base, said insert indicating the color of the cosmetic stick product found within the container.

19. A container for storing and dispensing colored cosmetic stick products comprising:

(a) an external base comprising (i) a portion for housing the cosmetic stick, (ii) a rotational assembly enabling extension and retraction of said stick, and (iii) a bottom portion which is hollowed out to form a cavity, (b) a cap which telescopically fits onto the base for covering the stick, (c) an insert comprising a colored thermoplastic material having the same shade as the cosmetic stick product found within the container, said insert fitted into the cavity in the bottom of the base and forming the bottom of the base.

20. The container of claim 19 wherein the color cosmetic stick is a lipstick.

21. The container of claim 18 wherein the insert and the color indicator are snapped into the cavity.

22. The container of claim 18 wherein the color cosmetic stick is lipstick.

* * * * *